United States Patent [19]

Sarvas

[11] 4,289,799

[45] Sep. 15, 1981

[54] METHOD FOR MAKING HIGH RESOLUTION PHOSPHORESCENT OUTPUT SCREENS

[75] Inventor: Walter P. Sarvas, Waukesha, Wis.

[73] Assignee: General Electric Company, Schenectady, N.Y.

[21] Appl. No.: 135,558

[22] Filed: Mar. 31, 1980

[51] Int. Cl.[3] ..... H01J 29/18; G21K 4/00

[52] U.S. Cl. ..... 427/65; 427/2; 427/72

[58] Field of Search ..... 427/65, 72, 2

[56] References Cited

U.S. PATENT DOCUMENTS

| | | | |
|---|---|---|---|
| 2,119,309 | 5/1938 | Batchelor | 427/72 |
| 2,798,821 | 7/1957 | Lehmann | 427/71 |
| 4,025,662 | 5/1977 | Sumner | 427/72 X |

*Primary Examiner*—James R. Hoffman

*Attorney, Agent, or Firm*—Wheeler, House, Fuller & Hohenfeldt

[57] ABSTRACT

A screen for converting an electron image to an optical image is made by coating a transparent substrate with 1 micron mean particle size phosphor in fluid thermoplastic material using a spinning method. When the thermoplastic is set it is heated to near melting and additional fine phosphor is driven into its surface with an ultrafine sponge. After baking, this first layer is coated with a slurry of coarser grain phosphor suspended in water and a silicate compound and the substrate is centrifuged. After this second layer is dry, a thin coat of lacquer is applied and dried followed by aluminizing the lacquer. The coated screen is then baked to drive off the lacquer volatiles.

8 Claims, 3 Drawing Figures

METHOD FOR MAKING HIGH RESOLUTION PHOSPHORESCENT OUTPUT SCREENS

This disclosure pertains to improved high resolution phosphorescent screens for use in electronic image display tubes, such as x-ray image intensifier tubes, and to a method for making the screens.

A typical x-ray image intensifier tube comprises an evacuated envelope which has an internal x-ray image input screen at one end and an internal phosphor output screen at the opposite end. The input screen comprises a layer of material which fluoresces differentially in response to absorption of an image-entraining x-ray beam. An electron emissive thin film photocathode overlays the fluorescent layer and is excited to emit photoelectrons in quantities depending on the intensity distribution of the exciting light from the fluorescent layer.

There are annular focusing electrodes disposed between the photocathode and the phosphor output screen which acts as an anode. The anode has a high positive potential applied to it relative to the photocathode, and when the focused electron beam impinges on the phosphor screen, it fluoresces and exhibits a minified but bright optical replica of the incoming x-ray image. In diagnostic x-ray systems, it is customary to locate an objective lens on the optical axis of the output phosphor screen and to direct the image through a beam splitter to various accessories such as photographic and television cameras which allows the image to be displayed in various ways.

High resolution is a requirement for electronic tubes that utilize a phosphor screen. This is especially true of the image tube family. Many studies have been made on the effects of phosphor particle or grain size, weight, packing density and deposition methods on optical image resolution. Usually, when high resolution is attained it is at the expense of other screen parameters such as electron-to-light conversion efficiency, brightness, electron penetration, ion damage or durability. In image tubes such as x-ray image intensifiers, high brightness and high resolution are of paramount importance since, in the last analysis, these parameters govern the quantity of diagnostic information that can be obtained from the system.

One way of increasing brightness is to increase the photocathode-to-anode potential so as to increase the electron velocity and produce more intense light scintillations for each electron that is absorbed. An adverse result of increasing the potential is that a thicker phosphor coating is required to avoid excessive electron penetration or "punch-through" of the phosphor that causes excessive noise. So up to this time, using thin phosphor screens made with prior art methods, potential was restricted to about 25 kiloelectron volts (kev) to minimize ion scattering, excessive penetration, and a high noise level. Then, however, brightness was not optimized. If, on the other hand, the phosphor layer was made thicker and of large phosphor grains, optical image resolution was not optimized. Thus, it is evident that the best phosphor screen is one that would enable the use of thick enough phosphor layers to permit high enough electron energies for high brightness without sacrificing resolution. The new method described hereafter achieves these objectives.

One prior method for phosphor deposition on a transparent screen substrate is to centrifuge a phosphor suspension on the substrate to improve the packing density of the phosphor and, hence, minimize thickness. Modular transfer functions of about 45% at 40 line pairs per millimeter have been attained by this centrifuge method. The high modular transfer functions resulted from use of fine grained phosphors, lower screen weights and a variety of other techniques. However, phosphor efficiency degraded and noise and electron penetration necessarily increased. Such thin screens were not satisfactory for x-ray image tubes which desirably should use an anode potential of about 30 kilovolts instead of being restricted to 25 kilovolts or even lower as has been the situation in the past. One centrifuging method is shown in U.S. Pat. No. 2,119,309 to Batchelor where a screen substrate having contained sides and covered with a fluid suspension of phosphor is rotated at high speed about an axis that is parallel with the plane of the substrate so its radial component of force will compact the phosphor and also tend to spread it out evenly. Sometimes a substrate is spun to distribute the phosphor. Spinning involves rotating a substrate which has been coated with a fluid phosphor suspension at relatively low speed about an axis that is perpendicular to the plane of the substrate in an attempt to cause the phosphor to spread out evenly but without necessarily compacting it. Spinning is illustrated in U.S. Pat. No. 4,025,662 to Sumner.

Another method of phosphor deposition is shown in U.S. Pat. No. 2,798,821 to Lehmann. This patent teaches brushing a fine grain phosphor onto a substrate that has been coated with a thermoplastic material that has been heated to near its melting point and then letting the layer set after which the excess phosphor that has not adhered is removed. This method produces smooth high resolution screens with which modular transfer functions in excess of 80% at 40 line pairs per millimeter have been obtained. However, the thin screens obtained with this method cannot be used in x-ray image tubes at operating potentials of 30 kev as electron penetration becomes excessive above 20 kev.

SUMMARY OF THE INVENTION

In accordance with the invention, a multiple phosphor layered screen is provided; wherein, a fine grain phosphor coating or layer is interfaced with a transparent substrate and a coraser grain coating or layer is formed on the fine grain coating. A conductive film such as of vaporized aluminum is then deposited on the coarse grain coating. The coarse grain coating has sufficient thickness to modulate electron penetration while the fine grain coating on the side of the screen which is visualized results in a smooth homogeneous appearance with the desired high resolution.

Briefly stated, in accordance with the invention, a transparent substrate is coated with a fluid thermoplastic material that is saturated with fine grain phosphor. This coating or layer is dried by spinning. The layer is heated to near its melting point and then an excess of fine grained phosphor is forced with a sponge into the molten coating which retains a uniform layer of fine particles. After cooling and oxidation of the thermoplastic coating by baking, a slurry comprised of coarser grain phosphor suspended in a water, electrolyte, (such as sodium bicarbonate) and silicate mixture is distributed over the coated thermoplastic layer by centrifuging. The second or coarser grain coating over the sponged-on coating provides the control for obtaining proper screen weights to overcome electron penetration at high anode potentials.

The new screen is notable for having improved resolution over screens made exclusively with a centrifuge method. Modular transfer functions of 75% at 40 line pairs per millimeter are obtainable. The side of the screen which is visualized has a smoother texture and appearance compared with one made solely by the centrifuge method. The silicate binder also improves the strength of the screen over that which can be obtained by the sponging method alone. Higher anode potentials can be used compared to screens made solely by the sponging method. The screen has fine grain phosphor particles next to the substrate, for smoother appearance, overlaid with a layer containing larger phosphor particles to improve phosphor electron absorption and conversion efficiency.

The structure of the new high resolution phosphor and the method of making it will now be described in greater detail in reference to the accompanying drawings.

DESCRIPTION OF A PREFERRED EMBODIMENT

Figure 1:
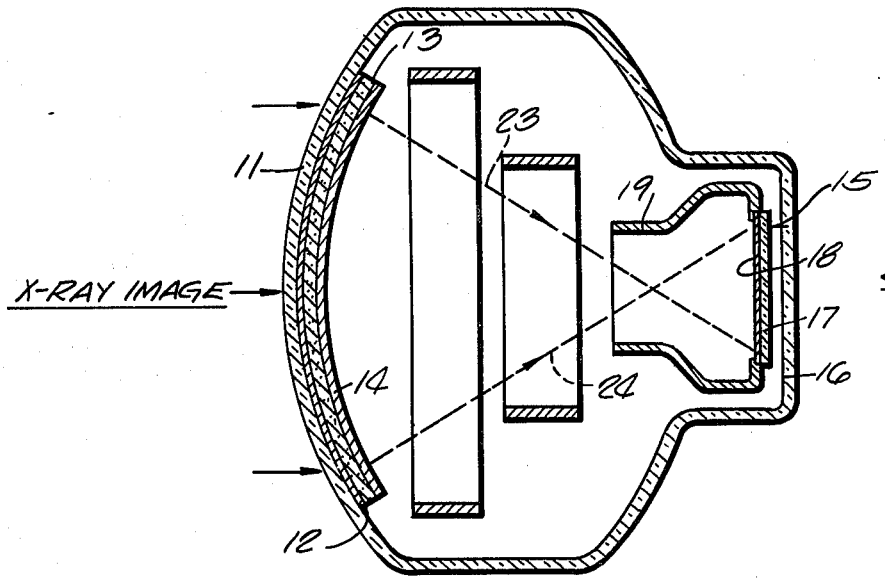
FIG. 1 is a longitudinal section through an x-ray image intensifier tube which will be used to illustrate one utilization of the new high resolution screen.

FIG. 1 shows an x-ray image intensifier tube which is one example of an electronic tube for converting an invisible radiation image to a visible image. The illustrative tube comprises a glass envelope 10 having a front or image input face plate 11. The incoming x-ray image is suggested by the arrows which are labeled x-rays. The inside surface of the face plate 11 may be coated with an x-ray transmissive but light opaque coating 12. A layer of material which fluoresces or emits visible light when an x-ray image impinges on it is marked 13. A layer of photoemissive material 14 is interfaced with fluorescent layer 13. The density of emitted electrons from any given area of the photoemissive layer 14 is proportional to the brightness of the corresponding area on the fluorescent layer. The photoemissive layer 14 serves as a photocathode since it is at a negative potential relative to the output image phosphor screen 15 which is held at anode potential. Screen 15 converts the electron image into a visible light image which can be viewed through the end wall 16 of the image tube. Screen 15 comprises a substrate 17, usually a thin wafer of glass, on which there is a layer or layers of phosphor material 18. A new method of making the phosphor screen will be described in detail later.

Phosphor screen 15 is mounted in a focusing electrode 19 which is maintained at a high positive potential relative to photocathode 14 when the tube is in operation. There are intermediate electrode rings 20 and 21 to which is applied an increasingly positive potential relative to the photocathode. Electrodes 21 and 22 create an electrostatic field for accelerating and focusing the electron beam in conjunction with anode electrode 19. The boundaries of the electron beam image are indicated by the dashed lines 23 and 24. It will be evident that the optical image formed on phosphor screen 15 is inverted relative to the electron image emitted from the photocathode.

The power supply for applying the photocathode 14 to anode 19 potential is not shown. The customary operating voltage for x-ray image intensifier tubes using phosphor screens made in accordance with prior art practices has been limited to about 25 kilovolts or less in some cases. As indicated earlier, maximum brightness levels would be obtained if higher potentials could be used. This has not been possible with prior art phosphor screens because of excessive electron penetration or punch-through and concomitant excessive noise that results in loss of image resolution.

Figure 2:
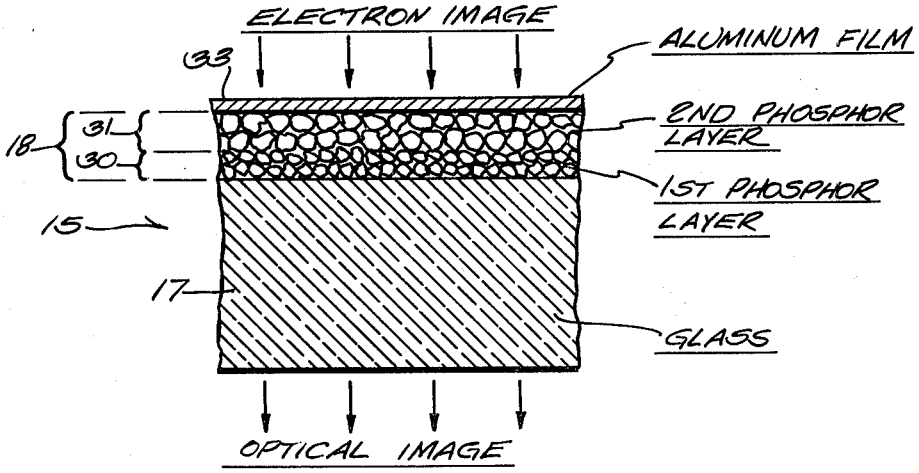
FIG. 2 is a sectional view of a phosphor screen made in accordance with the invention.

A magnified fragmentary cross section of the new phosphor output screen is depicted in FIG. 2. Basically, it comprises a transparent substrate 17 such as of glass and one or more phosphor layers which are collectively designated by the numeral 18. The first layer of finest grain phosphor, which may in itself comprise several discrete layers as will be explained later, is marked 30 and the second or coarser grain phosphor or layer or layers are marked 31. The phosphor layers are overlaid with a thin metal film 33 which is customarily aluminum deposited by vaporization. The electron image emitted by photocathode 14 is represented by the arrowheaded lines and a legend and the visible output image is represented by the arrowheaded lines having the optical image legend.

The method of making the new phosphor screen 15 will now be described in detail. The flow chart for the method is set forth in FIG. 3.

The first step is to make up a slurry or suspension of fine grain phosphor material, having a predetermined first degree of fineness, in a liquid which is thermoplastic when it is cured. A typical phosphor to use for electron-to-light images is Zn CdS:Ag (P-20) although other phosphors may be used. The mean particle size of the phosphor used in the first phosphor layer 30 of the screen, which is the finest to be used in the screen, is about 1 micron, in accordance with the invention but not in excess of 1.6 microns. A suitable thermoplastic suspension material is cellulose acetate dissolved in toluene but other thermoplastics such as vinyl chloride or polyethylene could be used with suitable solvents.

Figure 3:
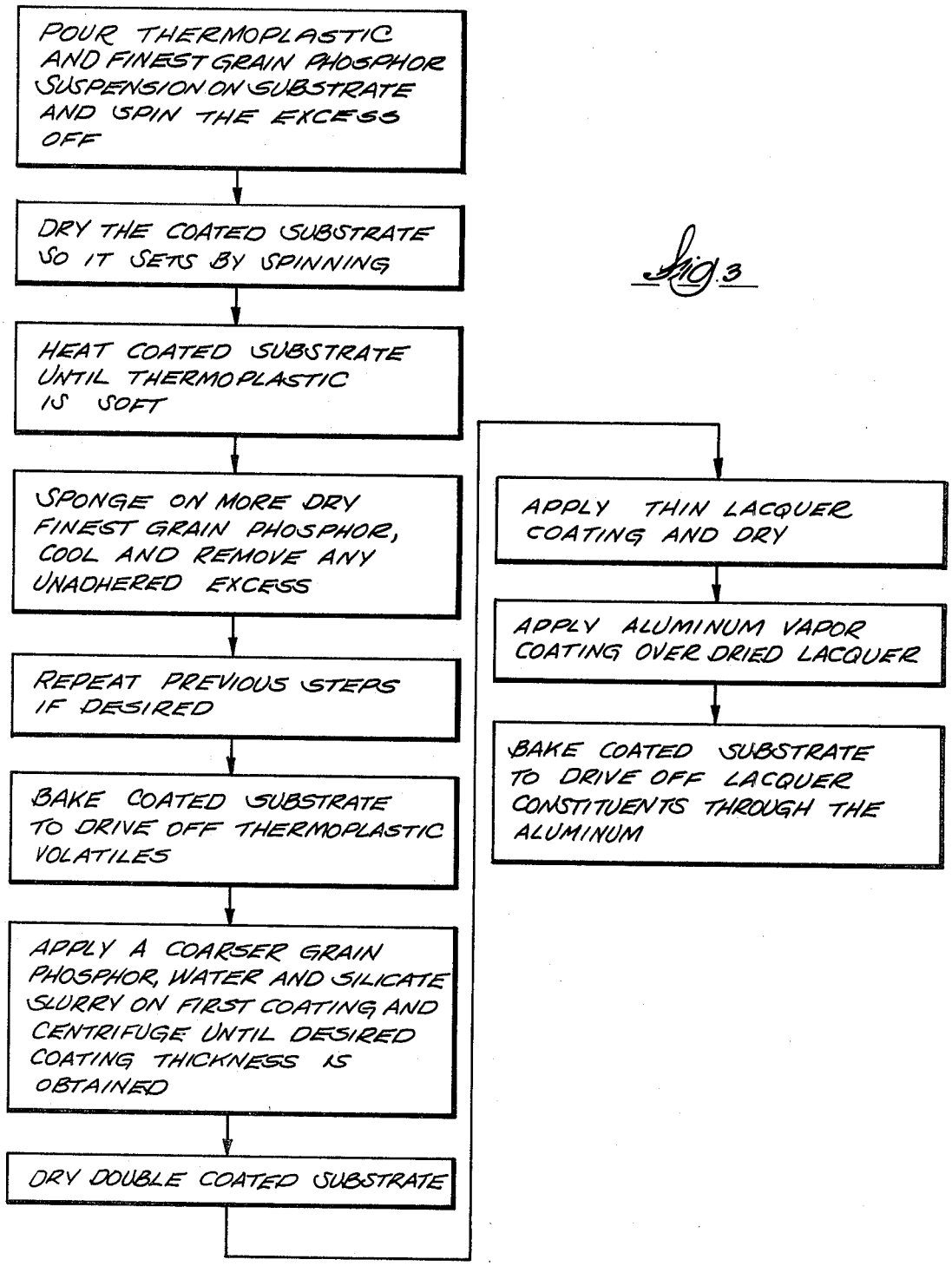
FIG. 3 is a flow chart showing the steps involved in making the new high resolution screen.

As can now be followed in the FIG. 3 flow chart, the slurry or suspension is then poured on substrate 17 and the substrate is subjected to spinning about an axis perpendicular to its plane to get the excess fluid off and reduce its thickness to a thin film. Spinning is stopped temporarily after the desired film thickness is obtained and then it is resumed to evaporate as much as possible of the volatile solvent. This leaves a uniformly thin dry coating of thermoplastic material saturated with phosphor particles.

The next step is to put the coated substrate on a hot plate and heat it until there is some softness or melting of the thermoplastic layer. Heating to a temperature of about 220° C. is appropriate for cellulose acetate.

The next step is to apply to the softened but not fluidized thermoplastic material additional 1 micron size dry phosphor. In accordance with the invention, this phosphor coating is applied with an ultrafine sponge. The sponge is used to pat or drive phosphor into the softened thermoplastic surface. The sponge may be wiped in circular motions over the surface to assure that the phosphor is uniformly distributed before patting is terminated. This patting step may be repeated three or four times to get the desired phosphor layer thickness. There is a natural limit to the amount of phosphor that the thermoplastic will retain. Finally, the substrate is allowed to cool and is blown with nitrogen to remove excess phosphor. This leaves a thin uniform layer of phosphor embedded in the thermoplastic layer. If a still thicker layer of the finest phosphor is desired, one may recoat with the thermoplastic slurry, spin-dry and reheat the thermoplastic and then repeat the sponging step. It should be noted that recoating may be done with a phosphor having the same grain size but a different chemical composition as is advantageous in some special types of screen but is ordinarily not necessary for x-ray image intensifier output phosphor screens.

The sponge used for the step just described typically has a mean open pore size of 10 mils and a durometer which is high enough to facilitate physically forcing the phosphor into the thermoplastic substrate but not so high as to result in any deformation or irregularities being imparted to the soft thermoplastic layer.

After the sponging step has been repeated one or more times as required, the next step is to bake the thermoplastic and phosphor coated substrate at about 350° C. for cellulose acetate to drive off all of its volatiles. The screen at this time has ultrafine grain and looks much like a film transparency. It would be good enough for electron beam energies of up to 20 kev or possibly 25 kev which is still too low for the brightness and resolution required for image intensifier uses. The method described up to this point is somewhat similar to the prior art method disclosed in U.S. Pat. No. 2,798,821 except that in the patent thermoplastic without any phosphor suspended in it comprises the first layer whereas in the present invention the thermoplastic is essentially saturated with the fine phosphor. A further difference is that additional fine phosphor is sponged on the molten thermoplastic, in accordance with the invention, as opposed to it being brushed on in accordance with the prior art.

When the volatiles are driven off of the thermoplastic layer by baking as described above, adhesion of the residual plastic and phosphor to the substrate is weak. Conventional practice would be to apply a suitable lacquer to the phosphor, aluminize it and bake it out to enhance adhesion. This, however, has the tendency to disadvantageously disturb the phosphor distribution uniformity.

The basic screen just described is improved with some additional steps which will now be described. In accordance with the invention, a slurry or suspension of phosphor, having a second degree of fineness coarser than the first, is utilized in a silicate-electrolyte medium that has been diluted with distilled water. Sodium silicate may be used but potassium silicate is preferred. Bicarbonates are typical of suitable electrolytes. In accordance with the invention, the particle size of the phosphor for this slurry is approximately three times the size of the particles in the previously described slurry. The second slurry is carefully poured over the first layer or coating on the substrate and centrifuged to obtain an optimum thickness for the electron energy at which it is desired to operate the image tube. The slurry's supernatant fluid is then optionally decanted or aspirated and the coating is dried.

Here again the versatility of the method becomes apparent in that one may use the phosphor particle size required for the resolution, electron stopping ability or thickness or other properties which one desires to optimize. For x-ray image intensifier tubes intended to operate at 30 kev or slightly higher, phosphors having a mean particle size of 2 microns with the largest particles no larger than 4.0 microns is recommended.

After drying the potassium silicate coating, a thin nitrocellulose lacquer is sprayed or floated on the second coating or layer to obtain a smooth glossy surface after the lacquer has been dried.

The next step is to deposit the aluminum film 33 by any of the well-known methods such as vaporizing the aluminum in an evacuated chamber. Unless the aluminum or other thin metal film is applied, electron bombardment and accompanying transverse ion scatter might cause degradation of the underlying phosphor.

After the phosphor layer is aluminized, the coated substrate is baked at the minimum temperature required to drive off the lacquer film constituents. They come off as carbon dioxide and methane primarily and penetrate through the aluminum film readily.

The phosphor output screen is now ready for installation in an x-ray image intensifier tube or other tube in which it is excited by means of an impinging electron image.

In summary, the structure and method of making a phosphor screen has been described. The screen is distinguished by eliminating electron penetration at 30 kev and by improved bonding of the phosphor layers to the substrate. By using the new method, multilayer screens comprised of different phosphor grain sizes and compositions can be obtained. The phosphor particle sizes and compositions may be so chosen that any or all parameters such as decay time, image resolution, electron penetration and graininess or lack of visual structure can be optimized. Insofar as is known, no prior art method permits such diversified manipulation of screen qualities.

I claim:

1. A method of making phosphorescent screens comprising the steps of:

coating a substrate with a slurry composed of substantially uniformly fine phosphor particles having a first degree of fineness suspended in a thermoplastic fluid, spinning said substrate to remove any excess slurry and to reduce the coating to the thickness desired, and permitting said thermoplastic fluid to set, heating said substrate and the coated layer formed as aforesaid until the thermoplastic softens or begins to melt, pressing onto said softened thermoplastic with a fine low durometer sponge more phosphor having said first degree of fineness and removing any excess phosphor particles which are not adhered, heating said substrate and the coating thereon to drive out the volatile constituents of the thermoplastic, depositing on said coating another coating of slurry composed of substantially uniformly fine phosphor particles having a second degree of fineness, which is more coarse that the first, suspended in a water and silicate mixture, and centrifuging the substrate to reduce said other coating to the desired thickness, drying said other coating, applying a thin coating of lacquer over said other coating and letting the lacquer dry, depositing a thin aluminum layer on said lacquer, and heating the coated substrate to drive off the volatile constituents of said lacquer.

2. The method as in claim 1 wherein:

after the first series of steps of depositing, spinning, heating, pressing in more phosphor with a sponge and heating the thermoplastic to drive out volatiles has been completed, the same sequence of steps is repeated one or more times to build up the thickness of the layer which has the finest particles.

3. The method as in claim 1 wherein:

after the first series of steps of depositing, spinning, heating, pressing in more phosphor with a sponge have been completed, the same sequence of steps are repeated one or more times using a phosphor having electron absorption characteristics which differ from those of the first phosphor used.

4. The method as in claim 1 wherein said thermoplastic fluid consists of cellulose dissolved in toluene.

5. The method as in claim 1 wherein said silicate is selected from the group consisting of sodium silicate and potassium silicate.

6. The method as in claim 1 wherein the coarser phosphor that has the second degree of fineness has characteristics which differ from the characteristics of the phosphor used in the first layer.

7. The method as in claim 1 wherein:

after the second series of steps of depositing another slurry of coarser phosphor particles suspended in a water and silicate mixture and drying said other coating have been completed, said second series of steps are repeated one or more times.

8. The method as in any of claims 1, 2, 3, 4, 5, 6 or 7 wherein the phosphor particles having said first degree of fineness have a mean size of about 1 micron and the particles having a second degree of fineness have a mean size of about 3 or 4 microns.

* * * * *